United States Patent [19]

Maranzano

[11] Patent Number: 4,863,165

[45] Date of Patent: Sep. 5, 1989

[54] VEHICULAR TRAFFIC ELECTRONIC GAME

[76] Inventor: Miguel F. Maranzano, 110 Pheasant Run, Bristol, Conn. 06010

[21] Appl. No.: 156,213

[22] Filed: Feb. 16, 1988

[51] Int. Cl.[4] ..... A63F 9/14

[52] U.S. Cl. ..... 273/1 E; 273/237; 273/86 B; 273/85 G

[58] Field of Search ..... 273/1 E, 85 G, 86 B, 273/237

[56] References Cited

U.S. PATENT DOCUMENTS

| | | | |
|---|---|---|---|
| 4,147,351 | 4/1979 | Saito | 273/86 B |
| 4,247,107 | 1/1981 | Smith et al. | 273/86 B |
| 4,330,127 | 5/1982 | Brand et al. | 273/86 B |
| 4,364,566 | 12/1982 | Neuhierl | 273/86 B |
| 4,568,300 | 2/1986 | Rasmussen et al. | 273/86 B |

*Primary Examiner*—Leo P. Picard
*Assistant Examiner*—Jessica J. Harrison
*Attorney, Agent, or Firm*—Robert S. Smith

[57] ABSTRACT

An electronic game which includes a generally planar board, at least one vehicle dimensioned and configured for movement along the board, indicia disposed on the board defining a start point and finish point, indicia disposed on the board representing a plurality of streets. The streets define a plurality of routes intermediate the start point and the finish point and game includes apparatus for measuring the speed of the vehicle along at least one of the routes. The game device also includes structure for defining a speed limit which is continuously varying independently of player action, and comparing the measured vehicle speed to the defined speed limit during play of the game.

15 Claims, 4 Drawing Sheets

VEHICULAR TRAFFIC ELECTRONIC GAME

BACKGROUND OF THE INVENTION

This invention relates to a toy that is entertaining and educational since it teaches the players, even children old enough to understand the rules, to achieve their goals within the framework of the law.

The prior art includes a number of electronic games including the following: 4,114,882; 4,196,904; 4,392,651; 4,394,018; 4,541,633; 4,561,659; Re 31,441. These patents are believed to be of only general interest even though they do show various electronic game devices.

It is an object of the invention to provide novel apparatus which simulates urban traffic situations.

It is another object of the invention to provide a game which may be played by a large number of players.

Still another object of the invention is to provide a game which cannot be mastered, that is, it cannot be mastered despite the number of times the player has played the game.

Yet another object of the invention is to provide a game which has low manufacturing costs, in part, because standard components having loose tolerance requirements are satisfactory.

SUMMARY OF THE INVENTION

It has now been found that these and other objects of the invention may be attained in an electronic games which includes a generally planar board, at least one vehicle dimensioned and configured for movement along the board, indicia disposed on the board defining a start point and a finish point, indicia disposed on the board representing a plurality of streets, the street define a plurality of routes intermediate the start point and the finish point, and means for measuring the speed of the vehicle along at least one of the routes.

The apparatus may also include means for defining a speed limit which may further include means for comparing actual speed to the speed limit. The means for defining a speed limit may continuously vary independently of any action by the player of the game and thus the game cannot be mastered.

The means for measuring speed may include at least one photoresistor. The means for measuring speed may further include at least one resettable, retriggerable, single-shot multivibrator and a second photoresistor, and each of the photoresistors may change resistance upon passage of the vehicle intermediate a respective photoresistor and ambient light. The means for measuring speed may utilize the interval between one complete cylce of the multivibrator as a reference in measuring speed and an interval of time for the vehicle to pass from the first photoresistor to the second photoresistor being less than one complete cycle for the multivibrator may indicate a a rate of speed which is less than the speed limit. The apparatus may also include an alarm and the alarm may be responsive to the apparatus and may include means for sounding the alarm if the rate of speed of the vehicle is greater than the speed limit defined by the multivibrator.

The routes may have a plurality of intersections and may have a plurality of traffic lights which may be disposed at various points along the various routes. The apparatus may also include means for measuring passage of the vehicle past at least one of the red lights. The means for measuring passage of the vehicle past at least one of the red lights may comprise at least one photoresistor. The means for measuring passage of the vehicle past at least one of the red lights may trigger the alarm if the vehicle passes through a red light. The means for continuously varying the speed limit may be accomplished in an unpredictable manner. A plurality of batteries may provide power to the game. The apparatus may include means to simultaneously power the game and charge the batteries and means to display an indication of the time for travel from the start point to the finish point.

BRIEF DESCRIPTION OF THE DRAWING

The invention will be better understood by reference to the accompanying drawing in which.

DESCRIPTION OF THE PREFERRED EMBODIMENT

Reference is made to FIGS. 1–6. The game emulates driving a vehicle on city streets 11. Its purpose is to make players drive from a fixed predetermined starting point 12 to a fixed predetermined destination 14, choosing any route desired, in the shortest possible time without committing any traffic violations such as speeding or violating a red traffic light.

Figure 3:
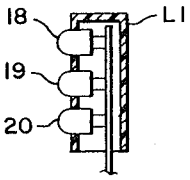
FIG. 3 is a fragmentary sectional elevational view of a typical traffic light in the apparatus of FIG. 1.
Figure 8:
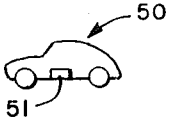
FIG. 8 is a schematic elevational view of a vehicle which includes a magnet
Figure 2:
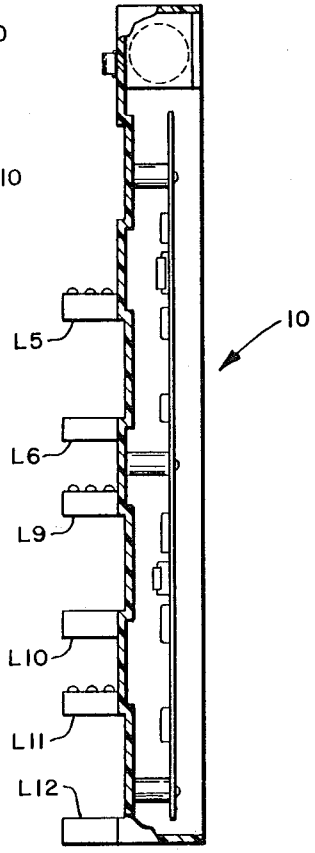
FIG. 2 is a sectional side elevational view of the apparatus shown in FIG. 1.

The board 10 has printed or molded indicia representing city blocks and the corresponding streets 11. If the board 10 is molded, the streets 11 are at a lower level with respect to the sidewalks just as they are in a real city. This is illustrated in FIG. 2. All streets are one way and allow driving from the starting point 12 to the finish point 14 along any route chosen by the player. At each intersection there is one of a plurality of conventional traffic lights 3 with sequentially operated red, yellow and green lights 18, 19 and 20 which are sequentially operated in the usual way. There is also a road section 22 that contains no traffic lights such as L1 but where the speed limit is checked by simulated radar. If a player jumps a red traffic light 18 or exceeds the speed limit which is not well known and varies continuously an alarm A1 sound and the player looses. The city layout is such that the player may travel part of the way on the street 22, a zone with no traffic lights but with radar control, or completely through a zone having only traffic lights and no "radar" control. When a player departs from the starting point 12, that player starts a clock 30 which is also automatically stopped upon arrival at the destination 14. The winner is the player that completes the trip in the least time without violating the traffic laws. The clock 30 is reset each time a new player is about to start by a reset switch 32 which has switch elements that reset the traffic violation alarm A1 as well as the clock timer 30.

One of the most important features of the game is that it cannot be mastered by experienced players no matter how often they play. This is a characteristic inherent in the design and will be explained in the paragraphs that follow. The clock 30 measuring the time elapsed from the starting point 12 to the finish point 14 and displays the elapsed time in seconds or other arbitrary units without departing from the spirit of the invention. The apparatus in accordance with the invention can be powered by either disposable batteries or rechargeable batteries 40 that fit in the same battery holder 42. In addition, the apparatus includes a power cord (not shown) 44 and a power supply that allows direct connection to a regular 120 Volt outlet (not shown) which can also charge the batteries 40 when the game is on, or if left plugged-in, after play with the game has ended. The vehicles 50 used in the game have a small magnet 51 that is used to operate a magnetic switch 52 to turn the clock 30 on at the starting point 12 of the game and a magnetic switch 54 to turn the clock 30 off upon arrival at the finish or destination point 14. The destination 14 as well as the starting point 12 are fixed on the board and cannot be changed by the players.

The speed is measured by means of photocells SD1 and SD2 embedded in the road surfaces 22 and its operation will be explained hereafter. The red light violation is controlled in a similar manner by a photocells JR1–JR18 embedded on the road surface right past the corresponding traffic light L1–L18 and linked with the red light 18 of the corresponding traffic light L1–L18 as also explained hereafter.

The traffic lights are not synchronized and operate at slightly different rates so that the probability of any given route having all traffic lights green in two consecutive turns is almost zero. This makes the toy impossible to master since the state of the traffic lights cannot be predicted. The "speed limit" in the section without traffic lights also changes constantly at an unknown rate and beyond the control of the players.

The game is unique in its conception and execution. The construction employs standard logic and integrated circuits and its nature makes close tolerances on component values not only unnecessary but undesirable. All other components, reed switches, magnets, transformers, etc, also have loose tolerance requirements. This is another very important characteristic of the game: its low manufacturing cost.

Figure 1:
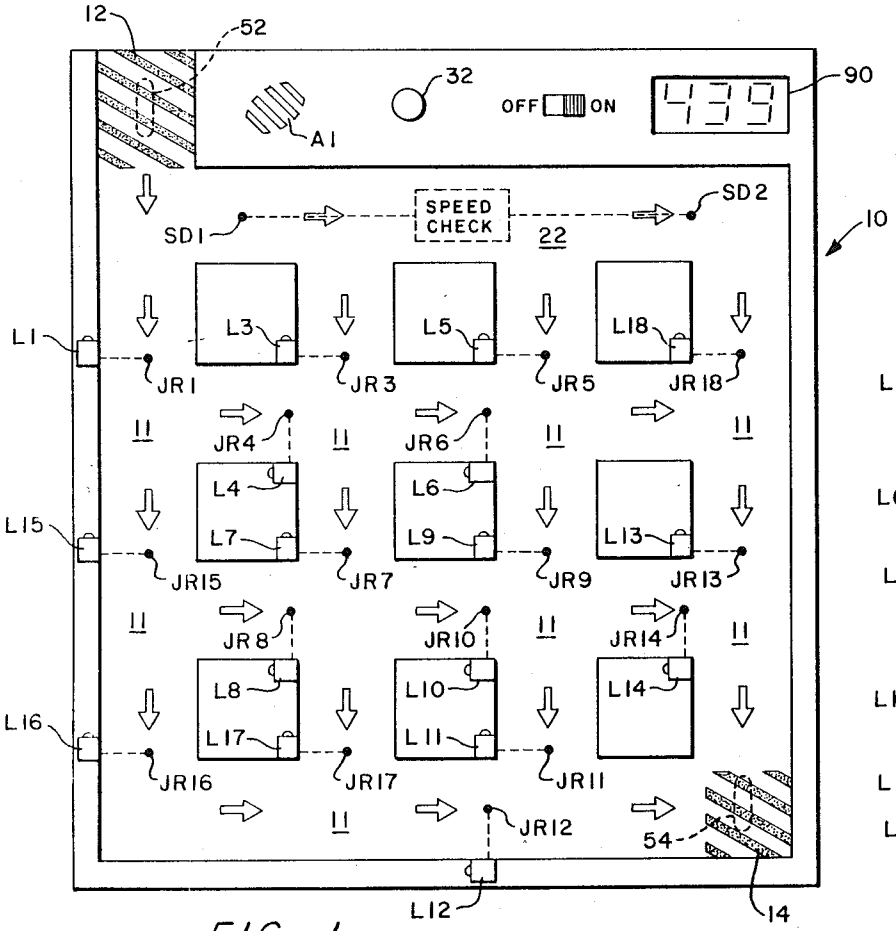
FIG. 1 is a partially schematic plain view of the apparatus in accordance with the invention.

Referring now to FIGS. 1 and 2 there is shown a plan view and partially schematic elevational view of the game board 10 in accordance with the invention showing the lights, radar check, city blocks, streets, start and finish points locations are indicated. FIG. 4–7 show the circuitry of the game and the power supply. Most traffic lights L1–L18 have substantially the same circuit configuration and for that reason only Intersections I & V are shown in detail and all other intersections are shown as a block. Most intersections have two traffic lights L1–L18 and have two red-light violation detectors JR1–JR18, one for each possible direction of travel. The speed control circuit 70 is linked to eight intersections from which it derives signals that modify the timing period of the oscillator IC-3. The violation alarm A1 is linked to both the speed control and circuit 70 and all the red lights 18 in the system through inverters 72, 74. The clock timer 30 is independent of the rest of the circuitry and is started and stopped by the reed switches 52, 54 that are activated by the magnet 51 in each vehicle 50.

Figure 4:
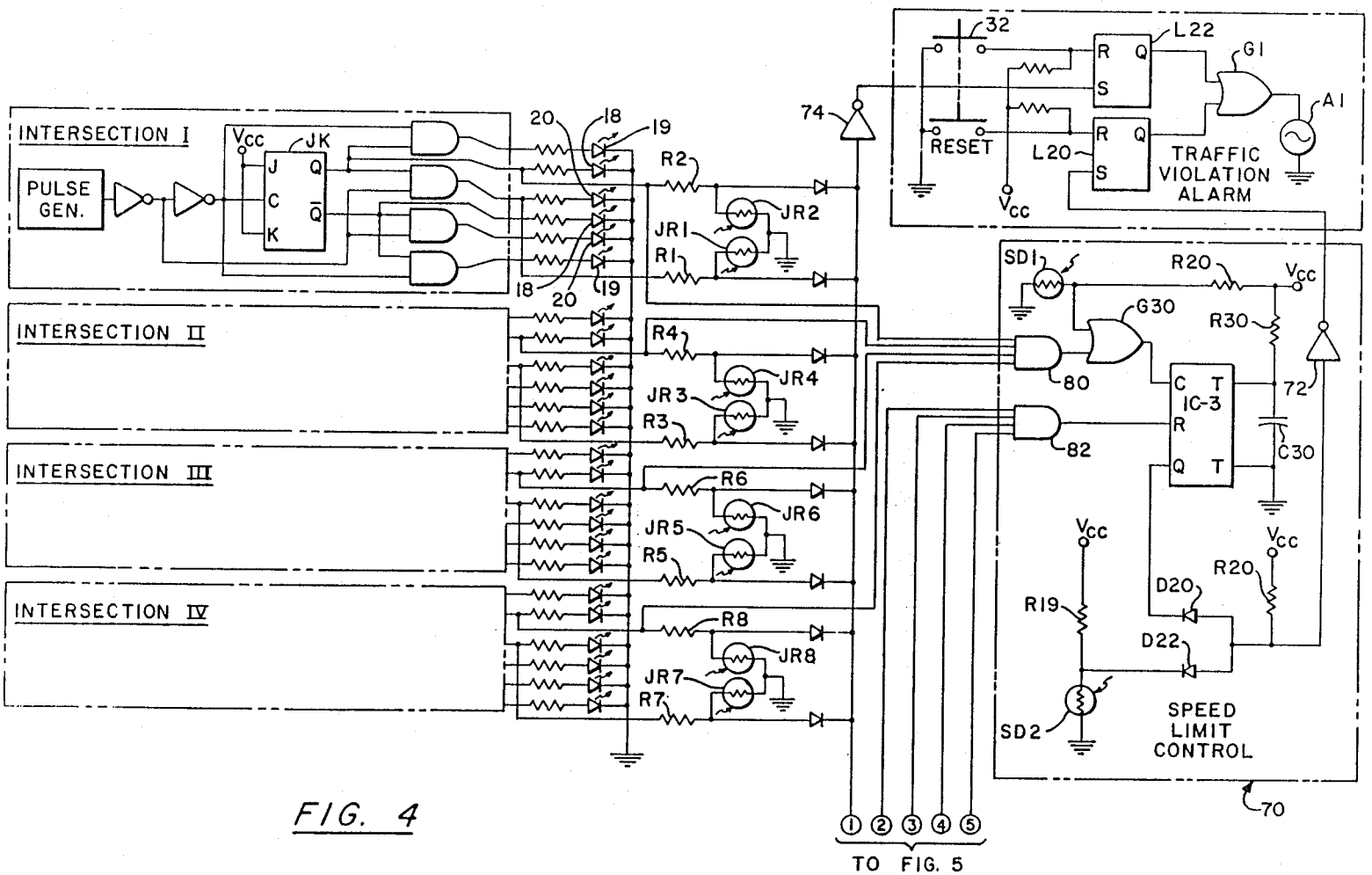
FIG. 4 is an electrical schematic showing circuitry for intersection I in detail and intersections II, III and IV in less detail and also speed limit control and traffic violation alarm circuits.
Figure 5:
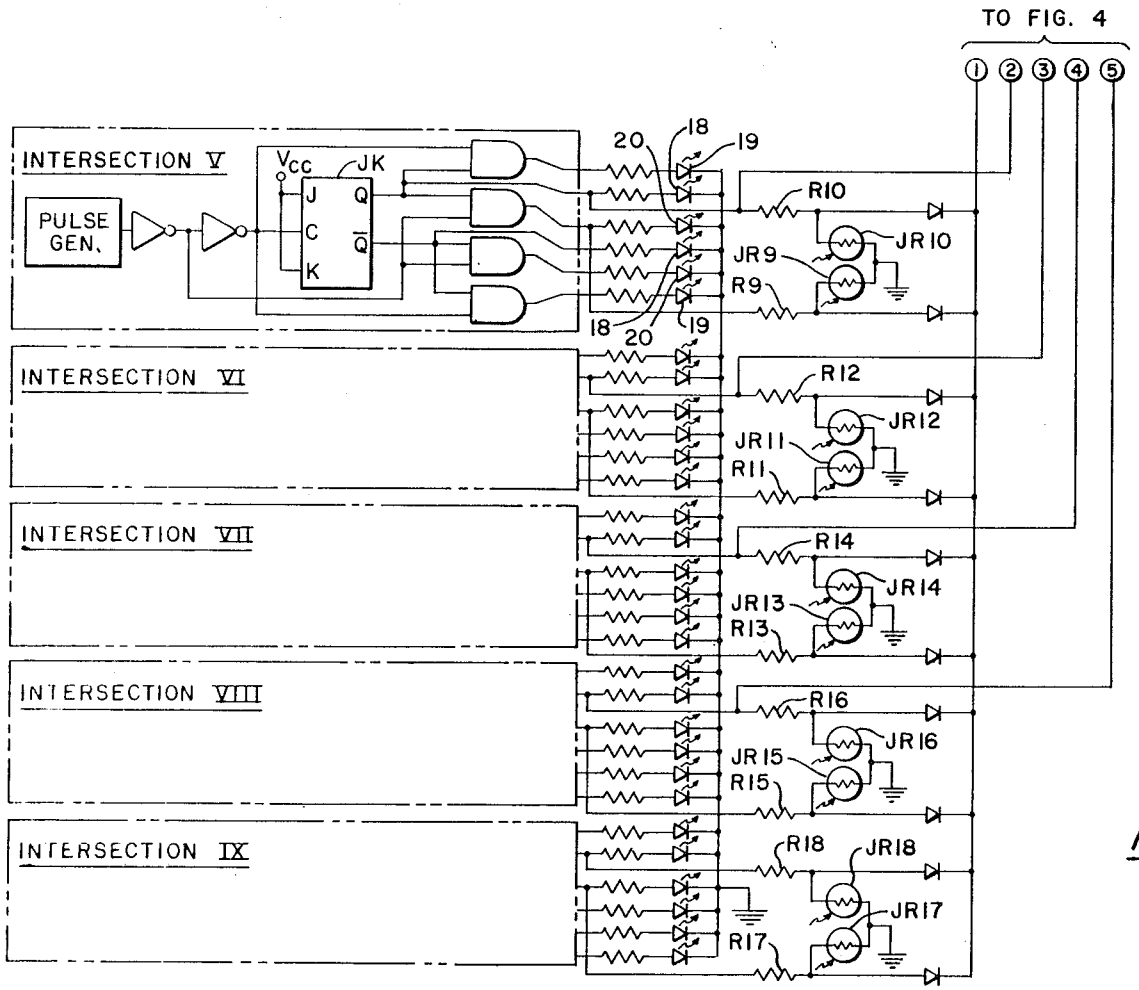
FIG. 5 is an electrical schematic showing the circuitry for intersections V, VI, VII, VIII and IX.
Figure 6:
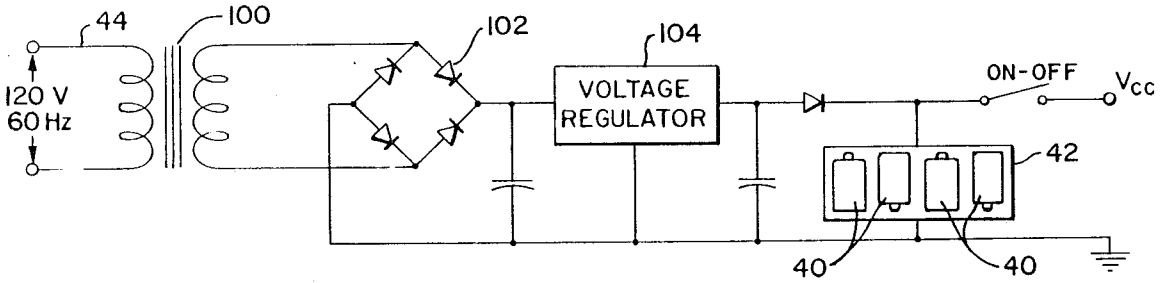
FIG. 6 is an electrical schematic showing the power supply for the apparatus.

The heart of the circuit for each intersection is a JK flip-flop connected for toggle operation on clock pulses provided by an oscillator (LM555 or similar) with less than a 50% duty cycle. The clock cycle last 6 seconds approximately but other time periods could be used. The period, however, determines the players waiting time at a red light 18 and therefore, too long a wait would make the game boring while too short a time would make it difficult to play. Within a range of reasonable values for the clock cycle, the toy can be made attractive to experienced as well as inexperienced players. The JK flip-flop output and its complement, the clock signal and its complement are gated as shown in FIGS. 4 and 5 to provide the outputs to drive the green, yellow and red lights 20, 19, 18 in the proper sequence.

The relatively short duty cycle allows for the duration of the ON condition of the yellow light 19 to be shorter than for the green 20 and the red 18.

RED LIGHT VIOLATION DETECTOR:

The output to each traffic light L1–L18 also feeds a resistor R1–R18-photoresistor JR1–JR18 combination that detects when a vehicle goes through a red light 18 and sends a signal to the latch L22 that sets the alarm A1 off. The alarm A1 continues to sound until reset. Its operation is as follows: when a red light 18 is ON, the voltage that turns the red L.E.D. ON also appears at the input of the resistor R1–R18-photoresistorJR1–JR18 combination. Since the illuminated resistance of the photoresistor is low, the voltage at the anode of the diode is not enough to operate the latch. When a vehicle goes over the photoresistor JR1–JR18 it prevents ambient light from reaching the photoresistor JR1–JR18 which switches to high resistance. Now the action of the resistor R1–R18-photoresistor JR1–JR18 voltage divider combination produces a voltage large enough to turn the diode on and set the latch which in turn causes the alarm to sound until reset by the switch 32. The output of the red light 18 also feeds one of the inputs of the gates that control the period of the Speed Control oscillator circuit.

SPEED CONTROL LOGIC:

The speed is controlled by measuring the time it takes a vehicle to go between two check points. The heart of the system is a resettable, retriggerable, single-shot multivibrator IC-3 such as the Motorola MC14538. When a player's vehicle goes over one of the photoresistors SD1 or SD2 below the "road" surface, it triggers the multivibrator IC-3 which begins its timing cycle. The multivibrator IC-3 output goes HIGH and appears at one input of the diode AND gate consisting of resistors R20, D20 and D22. If the player is not "driving too fast" it will reach the second photoresistor detector after the multivibrator IC-3 times out and its output went back to LOW. In this case the only HIGH input to the AND gate will come from the second detector. If, on the other hand, the player reaches the second detector SD2 before the multivibrator IC-3 times out, both inputs to the diode AND gate will be high and its output will set the latch 20, turning the violation alarm A1 ON through the OR gate G1.

While the timing is in progress, the signals from four of the red lights 18 may combine to bring the multivibrator IC-3 reset input LOW, causing its output to go LOW before the end of the normal period determined by resistor R30 and capacitor C30. With this input to the diode AND gate going LOW sooner, the output from the second sensor SD2 can go HIGH sooner without setting the alarm A1 latch L20. The net effect is equivalent to raising the "speed limit" since the player's vehicle may go between check points in less time and still not trigger the violation alarm A1. While timing is in progress, the signals from four other red lights 18 may combine to put a HIGH on the trigger input of the multivibrator IC-3 through the OR gate G30. This will cause the output to remain HIGH for another whole period (unless reset by the signal from the other red lights).

This is equivalent to lowering the "speed limit" since the player now will have to wait longer to reach the second speed detector SD2 or else, the player will set the latch L20 and trigger the alarm A1.

Another possibility is that the outputs from four red lights 18 may trigger the multivibrator IC-3 before the player's vehicle 50 goes past the first speed detector SD1. When the vehicle 50 does, it sends a second pulse to the multivibrator IC-3 through the OR gate G30, thereby extending the timing cycle and lowering the "speed limit". Since it is also possible that more than one pulse may be entered to the multivibrator IC-3 trigger input before the player's vehicle 50 goes over the first detector SD1, the speed limit may be lowered to uncommonly low values, such as would be the case in a traffic jam or an accident.

The players are not aware that this actions are taking place and this guarantees that the game will not be mastered by choosing to go through the zone with no traffic lights.

VIOLATION ALARM:

The alarm consists of a solid-state buzzer A1 that can be operated directly from the output of a standard gate G1. The complete system consists of an OR gate G1 that receives inputs from the red lights violation latch L22 and the speed violation latch L20. If any of these inputs is high the output of the OR gate G1 will turn the buzzer or alarm A1 which produces an audible sound of about 1 to 3 KHz depending on the particular device used. The alarm A1 will continue to sound until the latch 20 or 22 set by the violation is reset by pressing the button of the reset switch 32. This button simultaneously resets the Speed as well as the red light violation latches.

Figure 7:
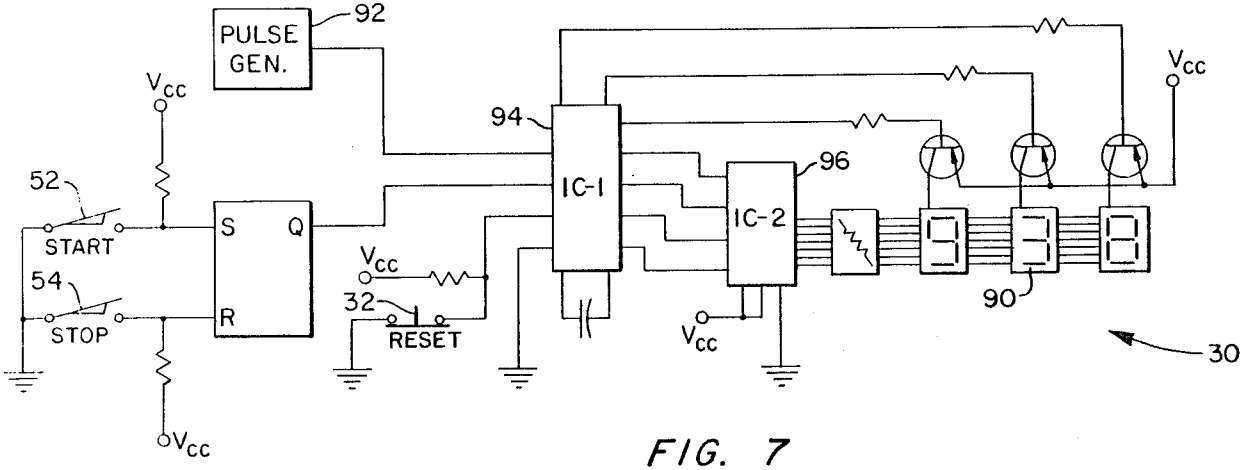
FIG. 7 is an electrical schematic showing the clock timer used in the apparatus.

ELAPSED TIME INDICATOR:

The clock timer 30 may be configured in any number of ways and the readout 90 does not have to be in any particular unit of time. It could be seconds, fractions or even multiples of it, having no effect on the operation of the game. As FIG. 7 shows, the clock timer 30 consists of a free running oscillator 92 that generates pulses which are fed to an up counter 94 such as a MC 14553. The output of the counter 94 is fed to a decoder/driver 96 (such as MC 14543) that controls the L.E.D. display.

When the start switch 52 is activated by the vehicle 50 leaving the starting point 12, the up counter 94 begins to count the pulses received from the oscillator 92 until stopped by the vehicle 50 arriving at the destination 14. The output of the counter 94 is decoded and continuously displayed by the read out 90 until reset. The next player will then be ready to go.

POWER SUPPLY:

The power supply consists of a small step down isolating transformer 100 providing the power to operate the game and recharge the batteries 40 at the same time. This useful feature allows totally discharged, rechargeable batteries 40 to be installed in the battery holder 42 and receive charge while the game is on. The secondary winding of the transformer feeds a full wave rectifier 102 and a voltage regulator IC104 supplies the filtered power to the electronics. Since this regulator 104 has the output short-circuit protected, the system is inherently power limited and there is no need to install fuses in case of an accidental short circuit when the batteries 40 are installed. In various forms of the invention, the various logic devices may be implemented in CMOS large scale integration or PAL large scale integration instead of the discrete components which have been illustrated and described with respect to the preferred embodiment. There is no limit to the number of players that can participate in a game since the players may sequentially take individual turns and play against a clock.

Having thus described my invention I claim:

1. An electronic game which comprises: a generally planar board;

at least one vehicle dimensioned and configured for movement alng said board;

indicia disposed on said board defining a start point and a finish point; indicia disposed on said board representing a plurality of streets, said streets defining a plurality of routes intermediate said start point and said finish point;

and means for measuring the speed of said vehicle along at least one of said routes, said game further including means for defining a speed limit and comparing actual speed to said speed limit, said means for defining a speed limit is continuously varying independently of any action by the player of the game.

2. The apparatus as described in claim 1 wherein:

said means for measuring speed includes at least one photoresistor.

3. The apparatus as describe in claim 2 wherein:

said means for measuring speed further includes at least one resettable, retriggerable, single-shot multivibrator.

4. The apparatus as described in claim 3 further including:

a second photoresistor, each of said photoresistors changing resistance upon passage of said vehicle intermediate a respective photoresistor and ambient light.

5. The apparatus as described in claim 4 wherein:

said means for measuring speed utilizes the interval of one complete cycle of said multivibrator as a reference in measuring the speed limit and where the passage of said vehicle from said first photoresistor to said second photoresistor in an interval of time which is less than one complete cycle of said multivibrator indicates a rate of speed which is less than the speed limit.

6. The apparatus as described in claim 5 further including:

in alarm, said alarm being responsive to said means for measuring speed, said alarm including means for sounding said alarm if said rate of speed of said vehicle is greater than the speed limit defined by said multivibrator.

7. The apparatus as described in claim 6 wherein:

said routes have a plurality of intersections and a plurality of traffic lights are disposed at various points along the various routes.

8. The apparatus as described in claim 7 further including:

means for measuring passage of said vehicle past at least one of said red lights.

9. The apparatus as described in claim 8 wherein:

said means for measuring passage of said vehicle past at least one of said red lights comprises at least one photoresistor.

10. The apparatus as described in claim 9 wherein:

said means for measuring passage of said vehicle past at least one of said red lights includes means for sounding said alarm if said vehicle passes through a red light.

11. The apparatus as described in claim 10 wherein:

said means for continuously varying the speed limit is accomplished in an unpredictable manner.

12. The apparatus as described in claim 11 further including:

a plurality of batteries for providing power to the game.

13. The apparatus as described in claim 12 further including:

means for simultaneously powering the game and charging said batteries.

14. The apparatus as described in claim 13 further including:

means for displaying an indication of the time for travel from said start point to said finish point.

15. An electronic game which comprises:

a generally planar board;

at least one vehicle dimensioned and configured for movement along said board;

indicia disposed on said board defining a start point and a finish point;

indicia disposed on said board representing a plurality of intersecting streets, said streets defining a plurality of routes intermediate said start point and said finish point; and means for measuring the speed of said vehicle along at least one of said routes; and means for defining a speed limit and comparing actual speed to said speed limit, and said means for defining a speed limit is continuously varying independently of any action by the player of the game.

* * * * *